US007562768B2

(12) United States Patent
Tokarski et al.

(10) Patent No.: US 7,562,768 B2
(45) Date of Patent: Jul. 21, 2009

(54) SCREW CAP PACKAGE FOR CONTACT LENS

(76) Inventors: Michael Tokarski, 500 N. Lakewood Run, Ponte Vedra, FL (US) 32082; James Peck, 217 W. Eagle Dr., Maple Grove, MN (US) 55369; Edward Dzwill, 9 Blossom La., Flemington, NJ (US) 08822; George Brock, 919 Garrison Dr., St. Augustine, FL (US) 32092; Michael D. Schulte, 9180 Village Green Dr., Montgomery, OH (US) 45242; Ronald K. Coleman, 354 Piedmont Rd., Columbus, OH (US) 43214; James R. Davis, 106 Wagnalls Ct., Pickerington, OH (US) 43147

( * ) Notice: Subject to any disclaimer, the term of this patent is extended or adjusted under 35 U.S.C. 154(b) by 141 days.

(21) Appl. No.: 11/486,658

(22) Filed: Jul. 14, 2006
(Under 37 CFR 1.47)

(65) Prior Publication Data

US 2008/0011618 A1 Jan. 17, 2008

(51) Int. Cl.
*A45C 11/04* (2006.01)
*B65D 39/00* (2006.01)

(52) U.S. Cl. ..... 206/5.1; 215/250; 215/253

(58) Field of Classification Search ..... 206/5.1, 206/205, 210, 219–222; 134/901; 294/1.2; 606/107; 623/6.11, 6.12; 220/203.08, 254.1, 220/254.8, 256.1, 257.1, 258.5, 288, 290.521, 220/522, 266, 268; 215/250, 253, 382; 222/153.01, 222/153.05, 153.06, 541.1, 541.6
See application file for complete search history.

(56) References Cited

U.S. PATENT DOCUMENTS

| | | | | |
|---|---|---|---|---|
| 2,954,148 | A * | 9/1960 | Corrinet et al. | 222/541.1 |
| 3,401,819 | A * | 9/1968 | Salamone | 220/258.5 |
| 5,954,233 | A | 9/1999 | Kawashima et al. | |
| 6,082,568 | A * | 7/2000 | Flanagan | 215/257 |
| 6,244,430 | B1 * | 6/2001 | Travis | 206/5.1 |
| 2007/0000792 | A1 * | 1/2007 | Newman et al. | 206/5.1 |

FOREIGN PATENT DOCUMENTS

| | | |
|---|---|---|
| EP | 0223581 | 5/1987 |
| EP | 1122183 | 8/2001 |
| WO | WO 2004/085278 | 10/2004 |

OTHER PUBLICATIONS

PCT International Search Report, dated Mar. 30, 2007, for PCT Int'l. Appln. No. PCT/US2006/027469.

* cited by examiner

*Primary Examiner*—Mickey Yu
*Assistant Examiner*—Melissa L Lalli

(57) ABSTRACT

A contact lens package includes a holder having a receptacle for holding a contact lens and a cap having a seal for sealing a contact lens within the receptacle. The cap is attached to the holder and is movable from an end of the holder where the receptacle is formed toward an opposite end of the holder. As the cap moves toward the opposite end of the holder, the end of the holder where the receptacle is formed ruptures the seal such that the contact lens can be removed from the package.

11 Claims, 4 Drawing Sheets

SCREW CAP PACKAGE FOR CONTACT LENS

FIELD OF THE INVENTION

The present invention relates to a contact lens package and, more particularly, to a screw cap package adapted for improved accessibility.

BACKGROUND OF THE INVENTION

Typically, contact lenses have been packaged in blister packs. Each blister pack is equipped with a single lens and has a concave-shaped receptacle for receiving the lens and a cover removably attached to the receptacle for enclosing the lens in the receptacle. While conventional blister packs provide a convenient means for shipping and storing contact lenses, they are not designed to consistently provide easy access to the contact lenses. Accordingly, there is a need for a contact lens package that consistently provides easy accessibility to the contact lens enclosed therein.

SUMMARY OF THE INVENTION

The present invention overcomes the disadvantages and shortcomings of the prior art discussed above by providing a new and improved contact lens package which includes a holder having a receptacle formed in one end of the holder, the receptacle being sized and shaped so as to hold a contact lens. The package also includes a cap attached to the holder such that the cap is movable from the end of the holder where the receptacle is formed toward an opposite end thereof. The cap has a seal positioned adjacent the end of the holder where the receptacle is formed for sealing the contact lens within the receptacle. The cap is movable from a first position, in which the cap is proximal to the end of the holder where the receptacle is formed, to a second position, in which the cap is intermediate the ends of the holder. As the cap moves from its first position to its second position, the end of the holder where the receptacle is formed ruptures the seal.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE INVENTION

Figure 1:
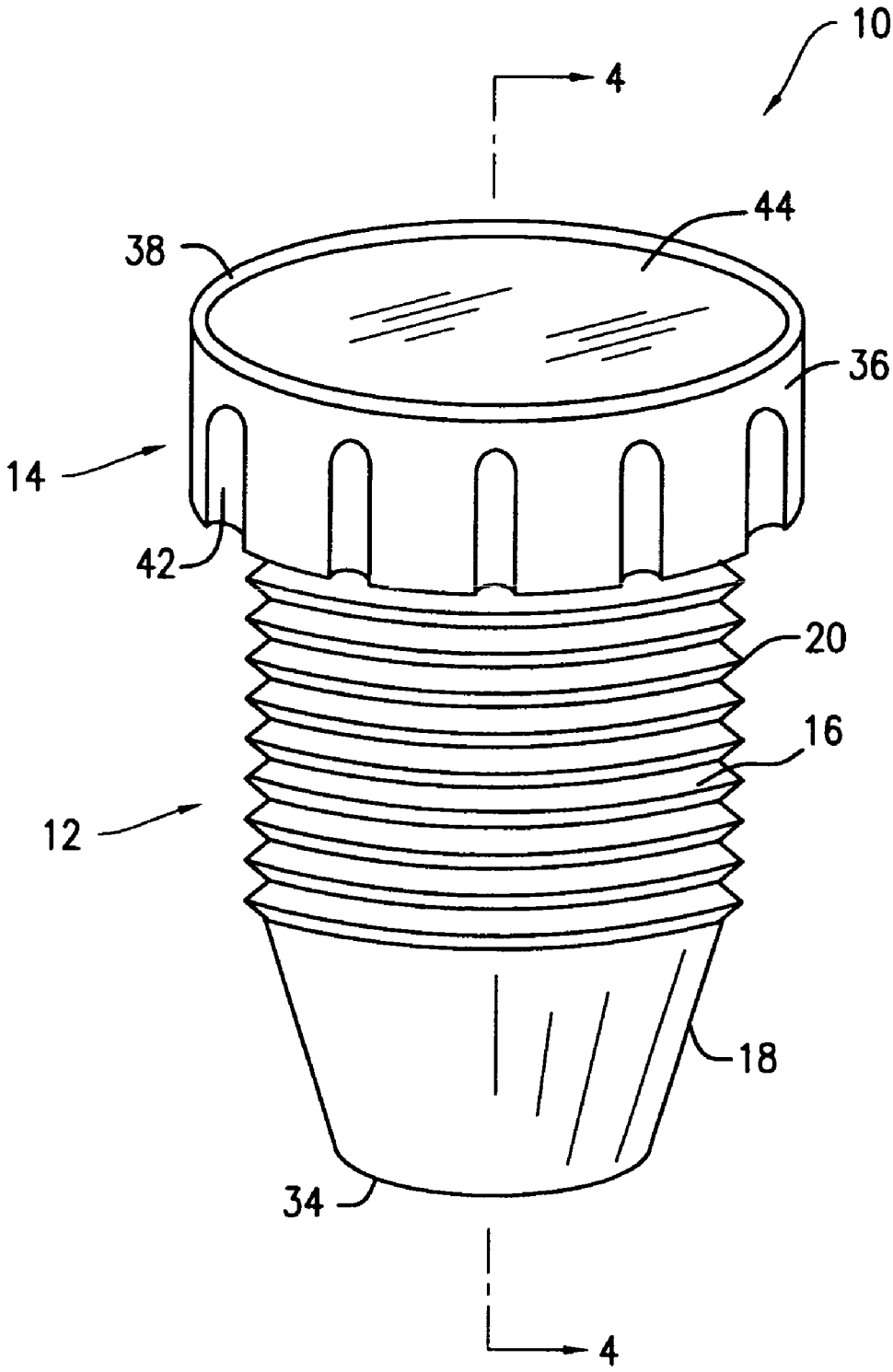
FIG. 1 is a perspective view of a screw cap package constructed in accordance with an exemplary embodiment of the present invention, showing the screw cap package in its closed position.

FIGS. 1-5 show a screw cap package 10 (or contact lens package) which includes a holder 12 and a screw cap 14 adapted to be moveable relative to the holder 12. The holder

12 has a main section 16 and a base 18 attached to the main section 16. The main section 16 of the holder 12 has a series of external threads 20 adapted to mate with the screw cap 14 for purposes to be discussed hereinafter.

Figure 3:
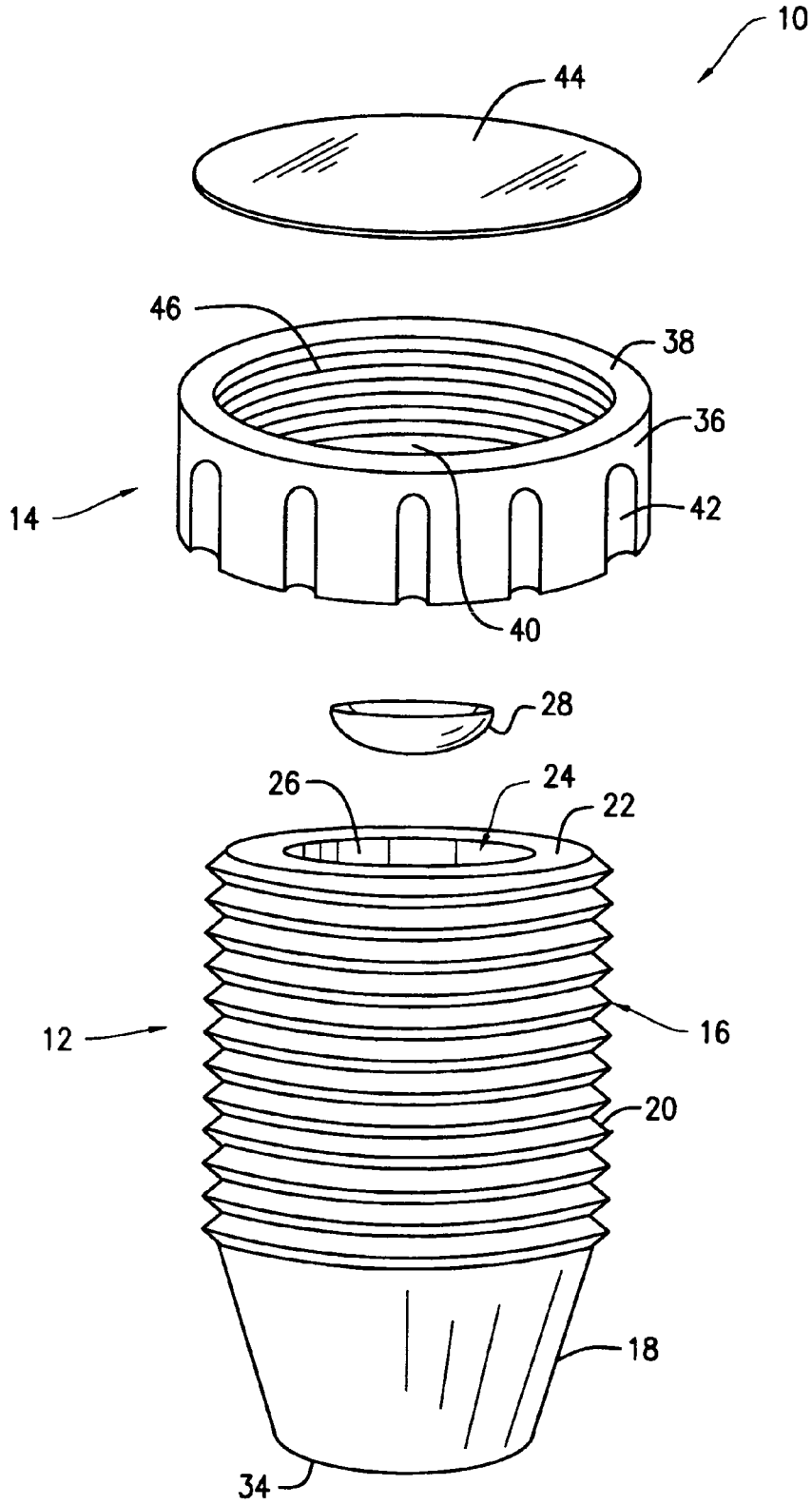
FIG. 3 is an exploded perspective view of the screw cap package shown in FIG. 1.

With particular reference to FIG. 3, the main section 16 of the holder 12 includes an annular rim 22, an opening 24 and a concave-shaped receptacle 26, all of which are formed in one end of the holder 12. The receptacle 26 is sized and shaped so as to receive a contact lens 28 and a conventional contact lens solution 30 (see FIGS. 4 and 5), such as saline solution, for maintaining the contact lens 28 in a hydrated state. The holder 12 has an internal bore 32 (see FIGS. 4 and 5) formed within an opposite end 34 of the holder 12. Alternatively, the holder 12 can be completely solid.

Figure 2:
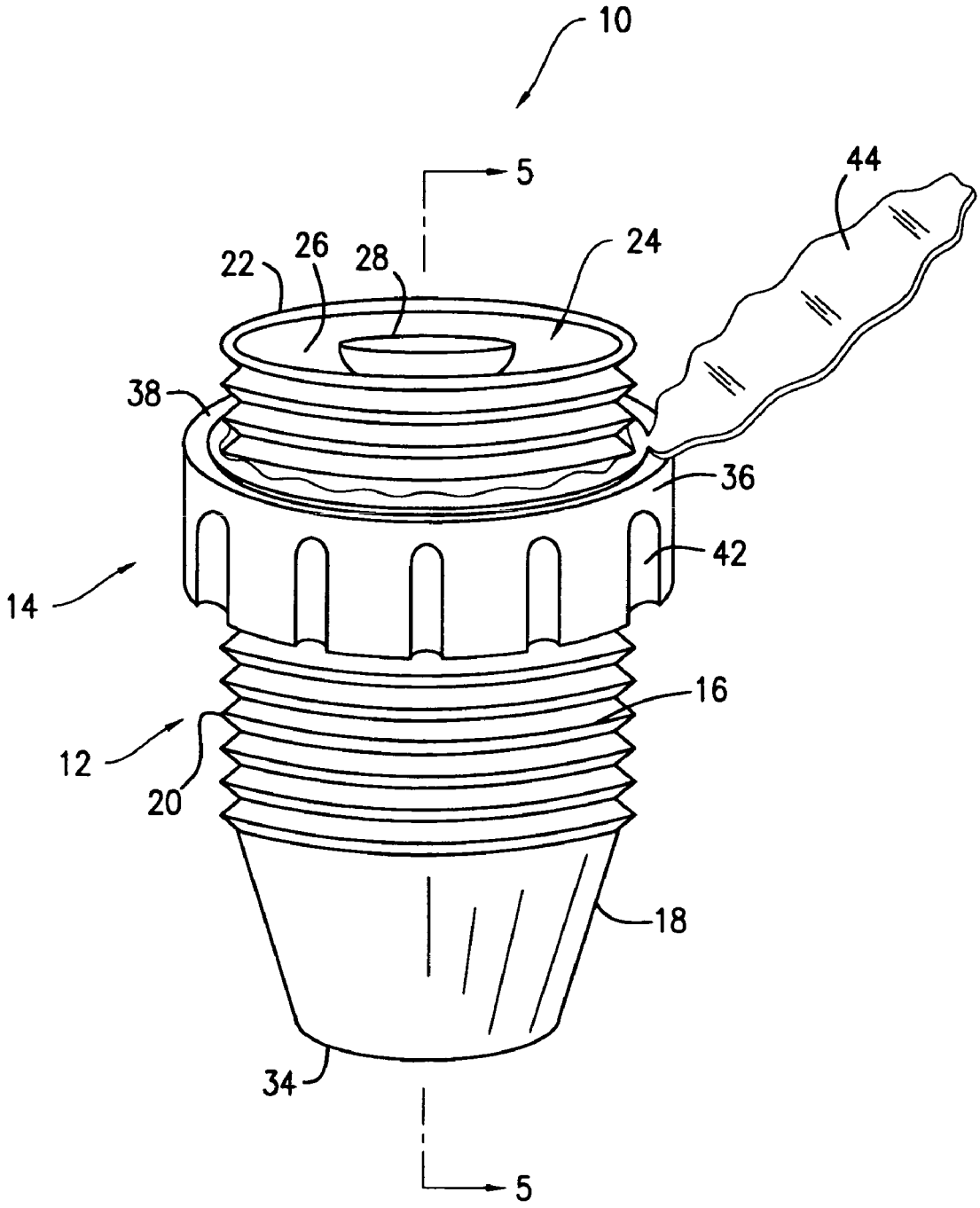
FIG. 2 is a perspective view of the screw cap package of FIG. 1, showing the screw cap package in its open position.

Referring to FIGS. 1-3, the screw cap 14 includes a cylindrically-shaped external wall 36 having an annular edge 38 and a center opening 40 (see FIG. 3). The external wall 36 has a plurality of longitudinally extending grooves 42 spaced along an outer surface thereof. The grooves 42 are designed for allowing a user to attain a firm grip on the screw cap 14 and to make it easier to rotate the screw cap 14. A breakable seal 44 is affixed to the annular edge 38 of the screw cap 14 so as to cover the center opening 40. The seal 44 can be made from any suitable material (e.g., a clear high barrier polymer laminate or a clear high barrier coextrusion) adapted to provide a reliable liquid-tight seal and to break in response to the application of a predetermined force.

Referring again to FIG. 3, the screw cap 14 also includes a series of internal threads 46 adapted to threadedly engage and mate with the external threads 20 on the main section 16 of the holder 12. The internal threads 46 and the external threads 20 cooperate with each other so as to allow the screw cap 14 to be securely connected to the holder 12 and also to allow relative movement between the screw cap 14 and the holder 12, as the screw cap 14 is rotated relative to the holder 12.

Figure 4:
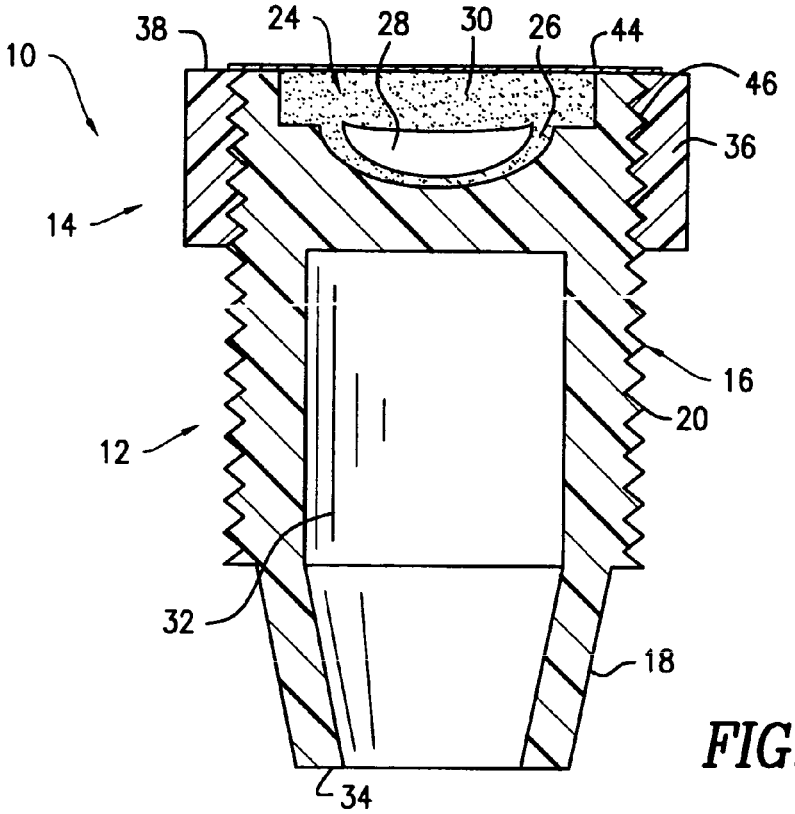
FIG. 4 is a cross-sectional view, taken along section lines 4-4 and looking in the direction of the arrows, of the screw cap package shown in FIG. 1 in its closed position.

With reference to FIG. 4, the screw cap 14 is attached to the holder 12 such that the internal threads 46 of the screw cap 14 mate with the external threads 20 of the holder 12 and the breakable seal 44 is positioned above the opening 24 of the holder 12. In this position, the seal 44 of the screw cap 14 covers the receptacle 26 formed in the opening 24 of the holder 12 to thereby enclose and seal the contact lens 28 stored within the receptacle 26. The screw cap package 10 is assembled and delivered to the user in this closed position, as shown in FIG. 1.

Figure 5:
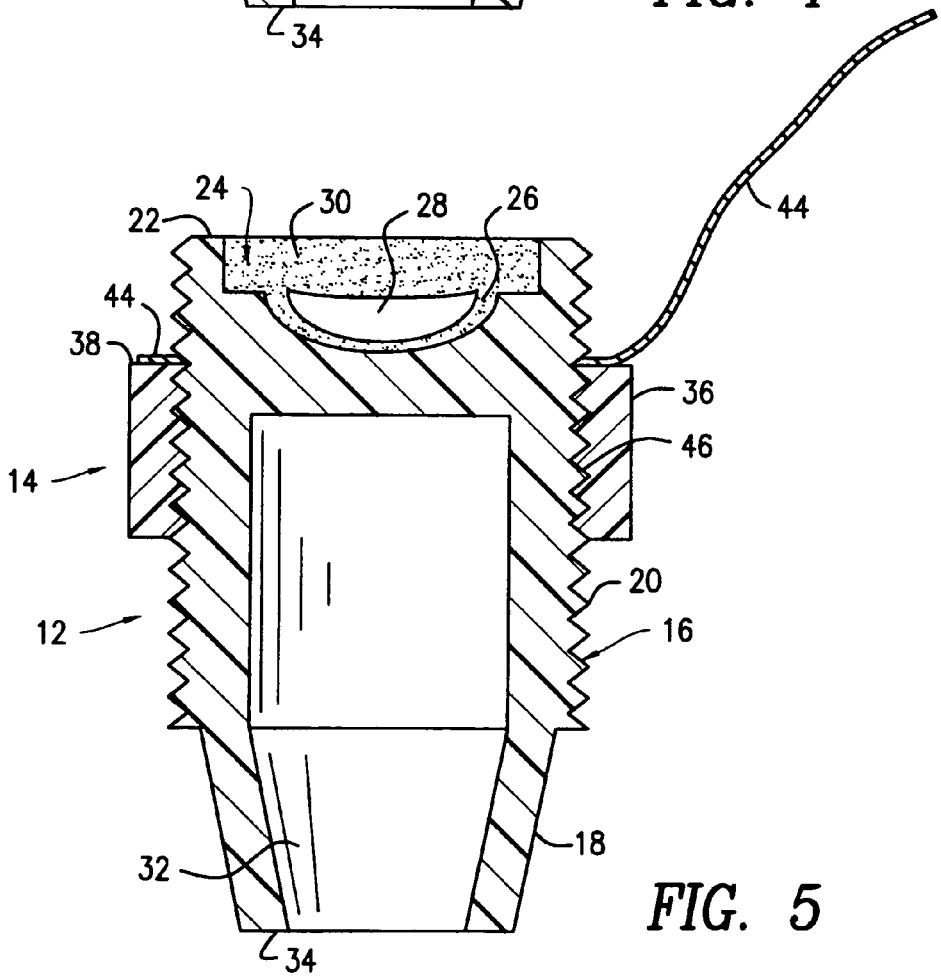
FIG. 5 is a cross-sectional view, taken along section lines 5-5 and looking in the direction of the arrows, of the screw cap package shown in FIG. 1 in its open position.

Referring to FIG. 5, the screw cap package 10 is opened as follows. A user grips the screw cap 14 with his or her fingers and then rotates the screw cap 14 relative to the holder 12. In this manner, the screw cap 14 is screwed (threaded) down over the holder 12. As a result, the breakable seal 44 on the screw cap 14 is forced against the annular rim 22 of the holder 12, thereby rupturing the seal 44 so as to expose the contact lens 28 (see FIG. 2) stored within the receptacle 26. The contact lens 28 can then be removed from the screw cap package 10.

It should be appreciated that the present invention provides a number of advantages and benefits. For instance, the present invention provides a screw cap package 10 adapted for improved accessibility.

It will be understood that the embodiment described herein is merely exemplary and that a person skilled in the art may make many variations and modifications without departing from the spirit and scope of the invention. For example, although the internal threads 46 and the external threads 20 cooperate with each other so as to allow relative movement between the screw cap 14 and the holder 12, other mechanisms can be utilized to allow relative movement between the screw cap 14 and the holder 12. All such variations and modifications are intended to be included within the scope of the invention as defined in the appended claims.

We claim:

1. A package for contact lenses, comprising a holder having a receptacle formed in one end of said holder; a contact lens stored in said receptacle along with a predetermined quantity of contact lens solution; and a cap attached to said holder such that said cap is movable relative to said holder, said cap having a seal positioned adjacent said one end of said holder for sealing said contact lens within said receptacle, said cap being movable from a first position, in which said cap is proximal to said one end of said holder, to a second position, in which said cap is intermediate said one end of said holder and an opposite end thereof, whereby said one end of said holder ruptures said seal as said cap moves from its said first position to its said second position.

2. The package of claim 1, wherein said holder includes a series of external threads.

3. The package of claim 2, wherein said cap includes a series of internal threads adapted to threadedly mate with said external threads of said holder.

4. The package of claim 3, wherein said external threads of said holder and said internal threads of said cap cooperate with each other so as to allow said cap to be connected to said holder.

5. The package of claim 4, wherein said external threads of said holder and said internal threads of said cap cooperate with each other so as to allow relative movement between said holder and said cap when said screw cap is rotated relative to said holder.

6. The package of claim 5, wherein said cap includes gripping means for gripping and rotating said cap.

7. The package of claim 6, wherein said gripping means includes a plurality of longitudinally extending grooves formed in said cap.

8. The package of claim 7, wherein said holder has an internal bore in said opposite end thereof.

9. The package of claim 1, wherein said cap includes an annular edge which supports said seal.

10. The package of claim 1, wherein said seal is made of a clear high barrier polymer laminate.

11. The package of claim 1, wherein said seal is made of a clear high barrier coextrusion.

* * * * *